United States Patent [19]

Lane

[11] Patent Number: 4,962,638

[45] Date of Patent: Oct. 16, 1990

[54] MULTI-POSITION OPEN-END SPINNING MACHINE

[75] Inventor: Robert Lane, Accrington, England

[73] Assignee: Hollingsworth (U.K.) Ltd., Orn, England

[21] Appl. No.: 407,079

[22] Filed: Sep. 14, 1989

Related U.S. Application Data

[63] Continuation of Ser. No. 273,545, Nov. 21, 1988, abandoned.

[30] Foreign Application Priority Data

Jan. 28, 1988 [GB] United Kingdom ..... 8801878

[51] Int. Cl.[5] ..... D01H 7/885; D01H 11/00; A47L 5/38

[52] U.S. Cl. ..... 57/301; 15/301; 57/304; 57/411; 134/21

[58] Field of Search ..... 57/301, 302, 304, 305, 57/406, 408, 411; 15/300 R, 301, 319; 134/18, 21, 37

[56] References Cited

U.S. PATENT DOCUMENTS

| | | | |
|---|---|---|---|
| 3,762,143 | 10/1973 | Stewart | 57/301 |
| 3,777,329 | 12/1973 | Lane | 15/301 |
| 3,839,764 | 10/1974 | Clayton | 15/301 |
| 3,884,028 | 5/1975 | Stahlecker et al. | 57/301 |
| 3,926,665 | 12/1975 | Harrap et al. | 134/18 |
| 3,952,492 | 4/1976 | Miyazaki et al. | 57/301 |
| 3,953,961 | 5/1976 | Harrap et al. | 57/411 X |
| 3,986,328 | 10/1976 | Harrap | 57/301 |
| 4,016,004 | 4/1977 | Koella, III | 134/21 |
| 4,162,556 | 7/1979 | van Ditshuizen et al. | 134/37 X |

FOREIGN PATENT DOCUMENTS

| | | |
|---|---|---|
| 2242594 | 3/1973 | Fed. Rep. of Germany . |
| 65058 | 1/1956 | France . |
| 2317389 | 2/1977 | France . |
| 1368740 | 10/1974 | United Kingdom . |
| 1400152 | 7/1975 | United Kingdom . |

*Primary Examiner*—John Petrakes
*Attorney, Agent, or Firm*—Cort Flint

[57] ABSTRACT

A multi-position rotary spinning machine includes an endless belt guided along the machine past a plurality of open-end spinning units each having a valve for operation by cam means of the belt to bring an eccentric port into and out of gas communication with another eccentric port of the valve by virtue of rotation of a rotary valve member driven by engagement of cam studs and carried by the belt with projections, respectively, of the rotary valve member.

The valves can be used for providing intermittent application of purging suction to the beater trash box of an open-end spinning or to a slub collection trough of a friction spinner.

15 Claims, 2 Drawing Sheets

MULTI-POSITION OPEN-END SPINNING MACHINE

This is a continuation of copending application(s) Ser. No. 07/273,545 filed on 11/21/88 and now abandoned.

FIELD OF THE INVENTION

The present invention relates to a multi-position open-end spinning machine having the requirement for regularly applied intermittent suction at each of the spinning units along the machine.

PRIOR ART

In the past, is has been known to provide intermittently applied suction for trash disposal from the trash box of a beater housing in an open-end spinning unit, and to achieve this it has been proposed, in GB-A-1 368 740, to employ a belt having a cam formation which drives a slide valve for translational movement between a closed position and an open position in which trash-clearing suction is applied to the trash box of the beater housing, and to use spring biasing to return it to the closed position in which that suction ceases.

OBJECT OF THE PRESENT INVENTION

It is an object of the present invention to provide an improved system for applying suction for cleaning a friction spinning unit.

SUMMARY OF THE INVENTION

According to one aspect of the present invention there is provided a multi-position open-end spinning machine including a plurality of open-end spinning units; a gas manifold extending along the spinning machine and serving several said spinning units; a plurality of gas valves each associated with a respective one of said spinning units; mutually registering first and second gas ports to each said valve, the second port communicating with said gas manifold and the first port communicating with a conduit leading to the associated spinning unit; a movable valve member driveable between a first position in which said first and second ports of the valve are in mutual communication and a second position in which said ports are isolated from one another; and an endless valve-operating drive member carrying cam means comprising a first cam portion which sequentially drives the movable valve members of the valves from a said second position to a said first position and a second cam portion which positively returns sequentially the valve members of said valves from a said first position to a said second position.

Preferably, the cam means each include pairs of cam portions so that the one achieves positive opening of the intermittent suction port and the other achieves positive closing of the same port. More preferably, the cam portions on the endless drive member and the cam follower on the valve are constructed such that one of the two cams can only effect opening of the communication between the registering first and second ports and the other of the two cams can only effect isolation of those ports, thereby avoiding the possibility of the valve inadvertently coming out of phase in that it opens when it should close, and vice versa.

According to a second aspect of the present invention there is provided a gas valve for use in an open-end spinning unit, and comprising a rotary valve plate defining a plurality of eccentric openings; a plurality of first cam-follower projections on the periphery of said rotary valve plate lying in a first plane perpendicular to the axis of rotation of the valve plate; a second set of cam-follower projections on the periphery of said valve plate lying in a second plane parallel to and spaced from the first plane; and first and second stationary guide plate members positioned in face-to-face contact with said rotary valve plate on either side thereof and defining, respectively, a first eccentric port and a second eccentric port registering with the first, whereby when the or a said eccentric opening in the rotary valve plate comes into register with both said mutually registering eccentric first and second ports gas is able to be communicated through the valve but when said rotary valve plate rotates to a position in which there is no such eccentric opening in register with the mutually registering eccentric first and second ports no gas is conducted.

DESCRIPTION OF THE DRAWINGS

In order that the present invention may more readily be understood, the following description is given, merely by way of example, with reference to the accompanying drawings, in which.

DETAILED DESCRIPTION OF A PREFERRED EMBODIMENT

Figure 1:
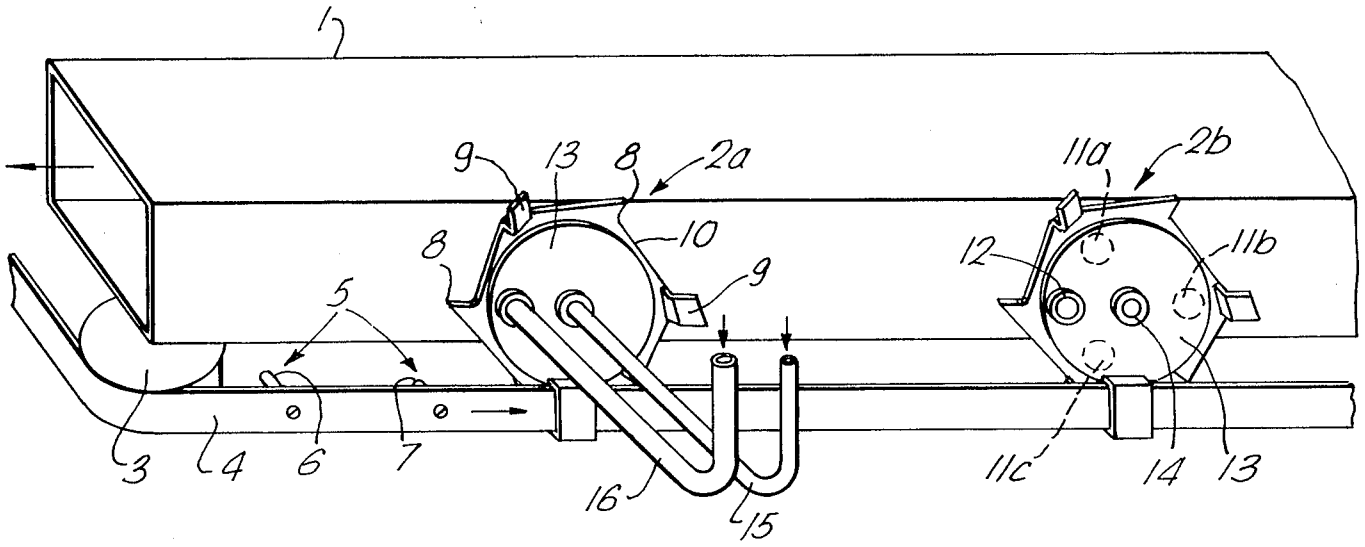
FIG. 1 is a perspective view showing two adjacent valves, with the ducts omitted from one of the two valves, in order to illustrate the porting of that valve.

As shown in FIG. 1, a longitudinally extending suction manifold 1 of a multi-position friction spinning machine has two adjacent suction control valves 2*a* and 2*b*, as well as other such valves which are not shown in the limited section of the suction manifold 1. There may be a single such suction manifold along the whole machine, or two arranged such that a respective one is on each of the two sides of the machine, or several longitudinally spaced manifolds serving sets of the spinning units of the machine.

At one end of the suction manifold 1 is a pulley wheel 3 around which (and around other such pulley wheels) passes an endless drive belt 4 carrying a relatively small number of spaced cam means 5 comprising a longer stud 6 and a shorter stud 7 upstanding from the belt.

The studs 6 and 7 of the cam means 5 engage with points 8 and 9, respectively, of a rotating valve plate member in the form of a star wheel 10.

Referring now to the valve 2*b* shown in FIG. 1, it can be seen that there are three eccentric openings 11*a*, 11*b* and 11*c* in the valve plate, in a circular array having a radius equivalent to the radius of eccentricity of a first eccentric port 12 of a fixed plate 13 on the front of the valve. The fixed plate 13 also defines a bracket 18 to guide the belt 4 so that the studs 6 and 7 are sure to strike the tips of the star wheel projections 8 and 9.

Figure 2:
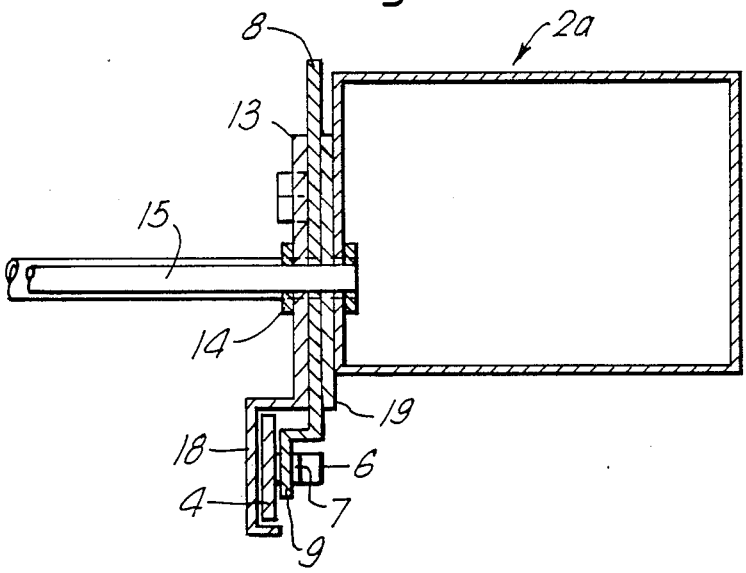
FIG. 2 is a cross-section through the main suction duct and on a plane which extends parallel to the axis of the valve port, and is shown by line II-II in FIG. 3.
Figure 3:
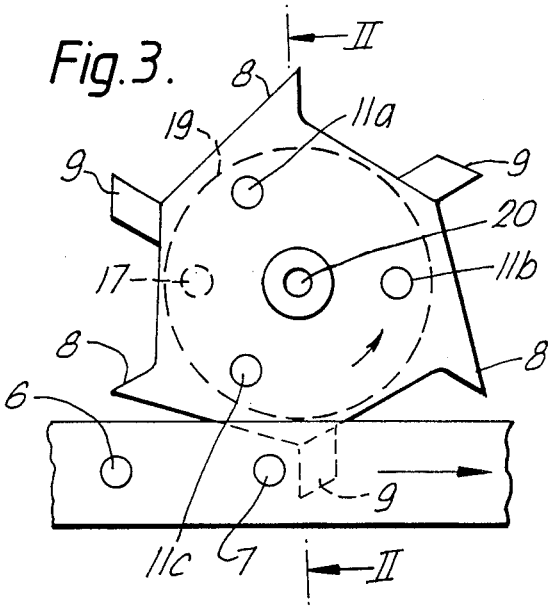
FIG. 3 is a front elevational view of the valve cam star and the cam studs on the drive belt, and in which the stationary front plate 13 has been omitted for purposes of clarity.

As shown in FIG. 3, the first eccentric port 12 formed in the stationary front plate 13 (shown in FIG. 1 and 2) is in register with a second fixed eccentric port 17 of the back plate 19, with which second port 17 the port 12 communicates when one of the rotating eccentric openings 11*a*, 11*b* and 11*c* comes into register with the first and second fixed eccentric ports 12 and 17, respectively.

Concentrically with respect to the fixed plate 13 is an optional continuously open first central port 14 in constant communication with a fixed second central port 20 (FIG. 3) of the back plate 19 of the valve.

The valve 2*a* of FIG. 1 shows a relatively small bore suction pipe 15 connected to the continuously open first central port 14 and a relatively larger bore suction pipe 16 connected to the first eccentric port 12 whose function it is to provide intermittently applied suction to the friction spinning unit.

In one form of friction spinning unit for which the valves 2*a*, 2*b* driven by the belt 4 are intended, the continuous suction applied by way of the smaller-bore line 15 provides an airflow of lower flow rate for clearing the trash box of the beater housing effective in the delivery of separate fibres from a feed sliver, and the intermittently applied suction provides an airflow of higher flow rate for clearing airborne fibre and fly from the friction spinning unit, for example from a slub collection trough of the unit, as disclosed in our EP-A-0179644. Alternatively or additionally, the continuous suction may be used for applying a suction effect to the exterior of the friction spinning rollers for attracting airborne dust and fly away from the rollers, as disclosed in our recently filed British Application No. 8801433.

The system could instead be applied to a multiposition open-end spinning machine in which the continuous suction applied by way of the line 15 is intended to maintain trash-clearing suction to a beater trash box of the respective rotor spinning unit and the intermittently applied suction by way of the larger bore duct 16 is intended to purge the same trash box at regular intervals.

By thus providing a constant suction of only small flow rate and only intermittently applied suction at a higher flow rate, the suction requirements for a multiposition machine can be made much more economical in that preferably only one of the many open-end spinning units is subjected to the intermittent suction at any one instant and thus the airflow demands on the manifold 1 are less stringent.

FIG. 2 shows in more detail the way in which the two cam studs 6 and 7 interact with the points 8 and 9 of the star wheel to ensure that the shorter first stud 7 of each cam means 5 is capable of only switching the valve 2*a* or 2*b* to an open position by bringing one of the openings 11*a*, 11*b* and 11*c*, into line with the first eccentric outlet port 12. The valve 2*b* in FIG. 1 is clearly in the closed position, i.e. the position which the valve occupies for the majority of its time until the purging suction is needed for a limited period at that spinning unit.

FIG. 2 shows the shorter stud 7 about to strike a cranked star point 9 in order to rotate the valve plate 10 through 60° to open the valve 2*a*.

If, inadvertently, the valve had finished up in the open configuration at the end of its previous cycle, and had remained in that configuration after the previous cam means 5 had left the valve, then it would still remain open when the shorter stud 7 passed because the star point in the path of the cam means 5 would not be the cranked one but would be the straight point 8 which can only be struck by the longer stud 6. Thus, at the end of the desired short-lived purging suction phase, the longer stud 6 would arrive and would trip the cranked star point 9 to bring the valve 2*a* back into the correct position, i.e. the closed position in which none of the openings 11*a*, 11*b* and 11*c* is in register with the first eccentric port 12.

The valve 2*a* or 2*b* might, for example, come out of sequence if an operator had inadvertently rotated the valve through an odd number of 60° increments, or through an angle which substantially corresponds to such a number of increments or if, for example, for some other reason the valve had been knocked. The system disclosed in FIG. 2 is therefore "self-righting" in the event of such an incident.

As indicated above, the pipe 16 from the first eccentric port 12 may, in a preferred embodiment, communicate with the purging suction to remove a torpedolike fibrous slub from a collecting trough in a friction spinner, for example a trough of the type disclosed in EP-A-0179644. Meanwhile, the constant suction on the pipe 15 to the first central port 14 may be applied continuously to the trash box of the associated beater housing. It is furthermore possible for the purging suction to be used for both the trash box of a beater housing of a friction spinning unit and the slub trough purge of the same friction spinning unit in which case either the suction capacity of the line 16 may be increased or two separate valves may be provided for each spinning unit such that the suction purge phases of the two functions (trash box emptying and slub collection) either do not overlap or overlap only partially.

When embodied in an open-end spinner, the apparatus may function such that the first eccentric port 12 and its pipe 16 are connected to a trash purge system of the beater housing whereas the first central port 14 and its pipe 15 may communicate continuously with the trash box of the beater housing for maintaining constant removal of lighter impurities from the trash box (the heavier impurities requiring a higher flow rate suction in order to remove them and thus being disturbed only by the intermittently applied purge suction).

Although the purging system in acccordance with the present invention is disclosed in terms of a rotary shut off valve, any other form of shut off valve may be included, provided it depends upon the two separate cam members for opening the trash valve and closing the trash valve once during an overall operating cycle of the trash purge mechanism which embraces all of the spinning units in the multi-position spinning machine.

Throughout the present description, the second eccentric valve port 17 is referred to as connected to a suction duct. However, because the valve can be used for either communicating suction, as in the preferred embodiment, or communicating pressurized gas such as air, the second eccentric port 17 may be connected to a pressurized gas manifold and hence the gas flow through the valve will be reversed in these two cases.

I claim:

1. A multi-position open-end spinning machine including a plurality of open-end spinning units; a gas manifold extending along the spinning machine and serving several said spinning units; a plurality of conduits leading to the open-end spinning units; a plurality of gas valves each associated with a respective one of said open-end spinning units; mutually registering first and second gas ports to each said valve, the second port communicating with said gas manifold and the first port communicating with said conduit leading to the associated said open-end spinning unit; a rotary valve member within said valve driveable between a first angular position in which the said mutually registering first and second ports of the valve are in mutual communication and a second angular position in which said first and second ports are isolated from one another; and an endless valve-operating drive member carrying cam means comprising a first cam portion which sequentially drives the rotary valve members of the valves from said second angular position to said first angular position and a second cam portion which positively sequentially returns the valve members of said valves from said first angular position to said second angular position.

2. A spinning machine according to claim 1, wherein said rotary valve member comprises a plurality of cam follower portions; and wherein said endless valve operating member is a belt and said first and second cam portions comprise first and second studs projecting from said belt for striking cam-follower portions of said rotary valve member.

3. A spinning machine to claim 2, wherein said rotary valve member has at least one eccentric opening means therein for alternately coming into register with said first and second ports to define said first angular position and coming out of register with said first and second ports for defining said second angular position of the valve member, wherein said cam-follower portions are projections on the periphery of said rotary valve member for engagement with the cam means.

4. A spinning machine according to claim 3, wherein said rotary member includes a first set of said projections equal in number to the number of said eccentric opening means for engagement with said cam means and a second set of said projections of the same number arranged alternatingly around the periphery with the projections of the first set, said second set of projections being constructed to engage only one of said cam portions of the or each cam means.

5. A spinning machine according to claim 4, wherein the projections of said second set are each arranged relative to a respective said eccentric opening means in the rotary member such that whenever a projection of said second set is struck by said first cam portion of the or a cam means the rotary member is driven from a said second position to a said first position.

6. A spinning machine according to claim 4, wherein there are three of said eccentric opening means in the rotary member, three of said projections in the first set, and three of said projections in the second set.

7. A spinning machine according to claim 3, and further including a stationary central aperture in said rotary member for constantly passing gas through said valve while said at least one eccentric opening means of said rotary member alternately opens and closes gas communication through said first and second eccentric ports.

8. A spinning machine according to claim 3, wherein said valve further comprises a bracket defining a rectangular guide for supporting said valve-operating belt passing the valve, such that cam means on the belt positively engage the cam-follower projections on the rotary member.

9. A spinning machine according to claim 2, wherein said first and second cam portions of the cam means comprise studs secured to said belt, said first stud being longer than the second; and wherein the projections of said second set are cranked to lie in a plane different from the plane occupied by the projections of the first set, so as to be engaged by both the longer second stud and the shorter first stud whereas the second set is engaged by only the shorter first stud of said cam means.

10. A spinning machine according to claim 1, wherein said gas manifold is a suction manifold.

11. An open-end spinning unit according to claim 1, wherein the rotary valve member comprises a rotary valve plate having a plurality of surfaces defining a plurality of eccentric openings; a plurality of first cam-follower projections on the periphery of said rotary valve plate lying in a first plane perpendicular to the axis of rotation of the valve plate; a second set of cam-follower projections on the periphery of said rotary valve plate lying in a second plane parallel to and spaced from the first plane; means to rotate said rotary valve plate by use of said first and second cam-follower projections; and first and second stationary guide plate members positioned in face-to-face contact with said rotary valve plate on either side thereof and defining, eccentrically thereof said first and second ports respectively, whereby when a said eccentric opening in the rotary valve plate comes into register with both said mutually registering first and second eccentric ports gas is able to be communicated through the valve but when said rotary valve plate rotates to a position in which there is no such eccentric opening in register with the first and second mutually registering eccentric ports no gas is conducted.

12. A spinning machine according to claim 11, wherein there are three of said eccentric opening means in the rotary valve plate, three of said projections in the first set, and three of said projections in the second set.

13. A spinning machine according to claim 11, and further including a stationary central aperture in said rotary valve plate for constantly passing gas through said valve while said at least one eccentric opening means of said rotary valve plate alternately opens and closes gas communication through said first and second eccentric ports.

14. A spinning machine according to claim 11, wherein said valve further comprises a bracket defining a rectangular guide for supporting said valve-operating belt passing the valve, such that cam means on the belt positively engage the cam-follower projections on the rotary valve plate.

15. A multi-position open-end spinning machine including a plurality of open-end spinning units; a gas manifold extending along the spinning machine and serving several said spinning units; a plurality of first and second conduits leading to the open-end spinning units with each open-end spinning unit associated with a respective said first conduit and a respective said second conduit; a plurality of gas valves each associated with a respective one of said open-end spinning units; mutually registering first and second gas ports to each said valve, the second port communicating with a said first conduit leading to the associated open-end spinning unit; a movable valve member within said valve driveable between a first position in which the said mutually registering first and second ports of the valve are in mutual communication and a second position in which said first and second ports are isolated from one another; an endless valve-operating drive member carrying cam means comprising a first cam portion which sequentially drives the movable valve members of the valves from said second position to said first position and a second cam portion which positively sequentially returns the valve members of said valves from said first position to said second position; and a third port communicating with the respective said second conduit of the associated open-end spinning unit, said third port being adapted to provide a constant connection between said gas manifold and said respective second conduit.

* * * * *